United States Patent [19]

Hatch et al.

[11] 4,083,159

[45] Apr. 11, 1978

[54] STRUCTURAL SOUND ABSORBING PANEL FOR UNDERWATER USE AND METHODS OF MAKING SAME

[75] Inventors: Donald M. Hatch, Huntington Beach; George D. Lee, Monterey Park, both of Calif.

[73] Assignee: Hitco, Irvine, Calif.

[21] Appl. No.: 410,639

[22] Filed: Oct. 29, 1973

[51] Int. Cl.[2] ..... E04B 1/99; D03D 3/00

[52] U.S. Cl. ..... 52/309.1; 52/309.3; 52/309.14; 52/612; 52/615; 428/116; 428/188

[58] Field of Search ..... 52/615, 612, 309, 145, 52/309.1, 309.3, 309.14; 161/39, 68; 156/79; 340/5 D; 428/116, 117, 188

[56] References Cited

U.S. PATENT DOCUMENTS

| | | | |
|---|---|---|---|
| 2,445,290 | 7/1948 | Gonda | 161/139 |
| 2,528,049 | 10/1950 | Gonda | 52/145 |
| 2,572,924 | 10/1951 | Gonda | 161/139 |
| 3,046,172 | 7/1962 | Reid | 161/DIG. 5 |
| 3,079,289 | 2/1963 | George et al. | 161/DIG. 5 |
| 3,087,567 | 4/1963 | Kurtze | 161/DIG. 5 |
| 3,087,574 | 4/1963 | Watters | 161/DIG. 5 |
| 3,102,559 | 9/1963 | Koppelman et al. | 161/68 |
| 3,239,982 | 3/1966 | Nicosia | 52/615 |
| 3,295,278 | 1/1967 | Muhm | 52/615 |
| 3,660,849 | 5/1972 | Jonnes et al. | 161/159 |
| 3,792,141 | 2/1974 | Offutt | 156/79 |

FOREIGN PATENT DOCUMENTS

| | | | |
|---|---|---|---|
| 1,578,022 | 7/1969 | France | 52/612 |
| 546,686 | 7/1942 | United Kingdom | 52/309 |

*Primary Examiner*—Price C. Faw, Jr.
*Assistant Examiner*—James Lee Ridgill, Jr.
*Attorney, Agent, or Firm*—Fraser and Bogucki

[57] ABSTRACT

An underwater panel comprises a three-dimensional structure for housing sound absorbing material therein, the structure being waterproof and extremely rigid in construction to prevent compression of the sound absorbing material in an environment of relatively high water pressure while at the same time being relatively highly sound transmissive so as to readily pass energy waves from the surrounding water into the sound absorbing material. The panel comprises an integrally woven and resin impregnated fabric which is relatively highly sound transmissive and which has a pair of waterproof opposite faces joined by a pair of intermediate ribs. A plurality of generally planar stiffening elements which are highly sound transmissive and which may be made from resin impregnated fabrics are inserted into the fabric so as to extend between the opposite faces and provide substantial resistance to compression of the panel due to the pressure of the surrounding water. These stiffening elements which are either disposed adjacent single ribs or within pockets formed by parallel pairs of ribs combine with the ribs to define spaces between the opposite faces in which highly sound absorbent material resides.

8 Claims, 4 Drawing Figures

Fig. 1
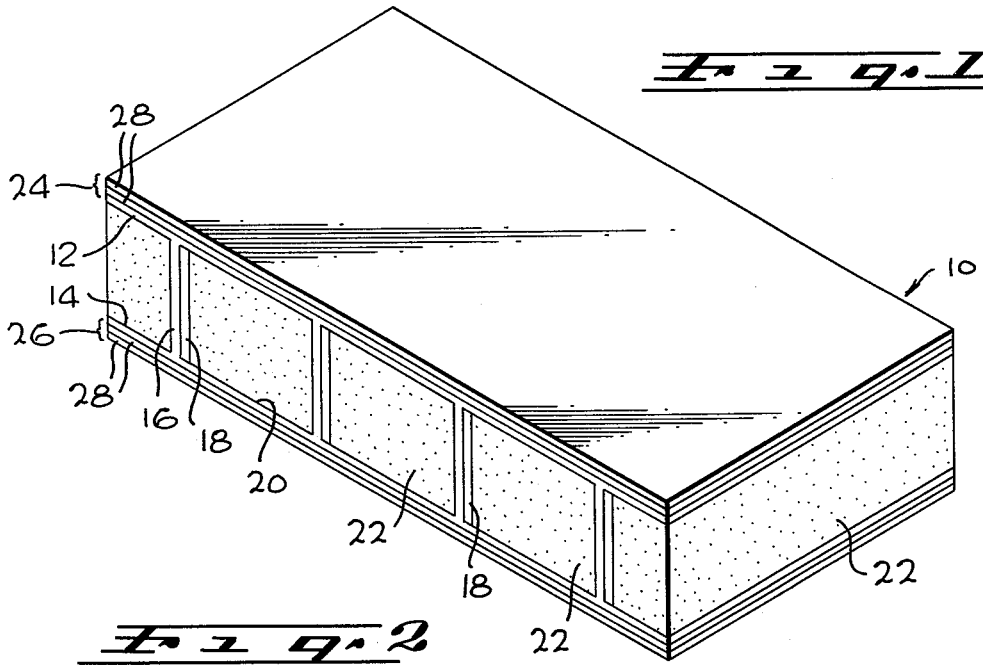
Fig. 2
Fig. 3
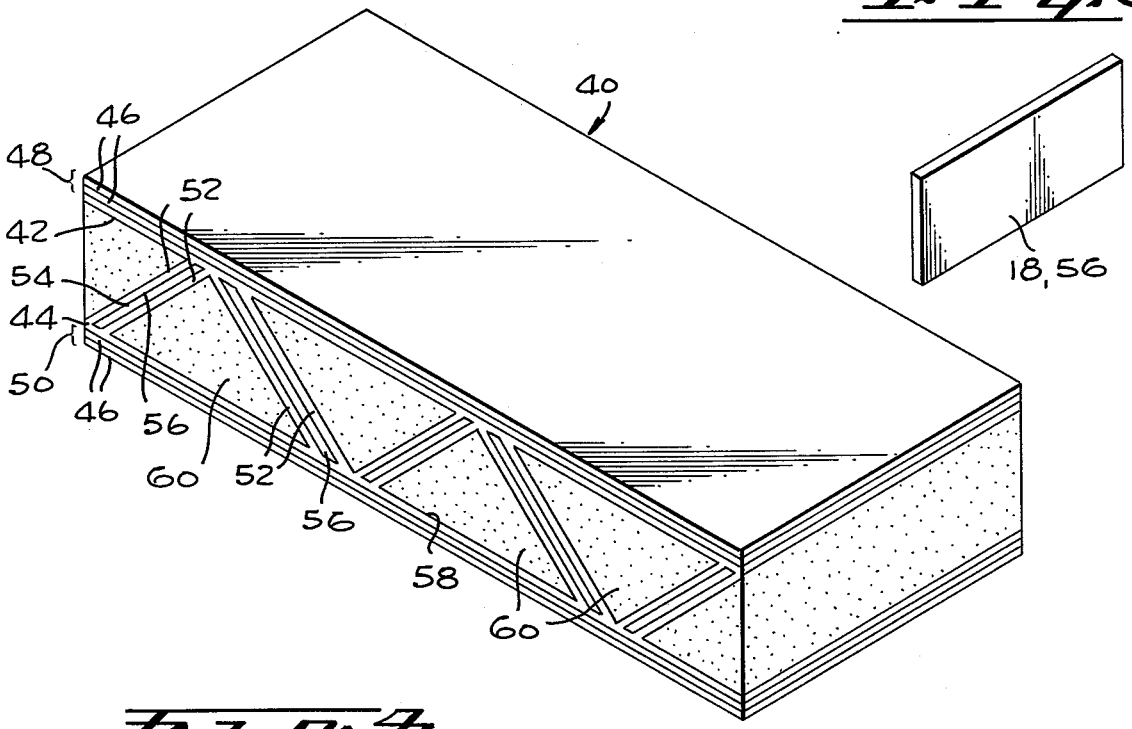
Fig. 4
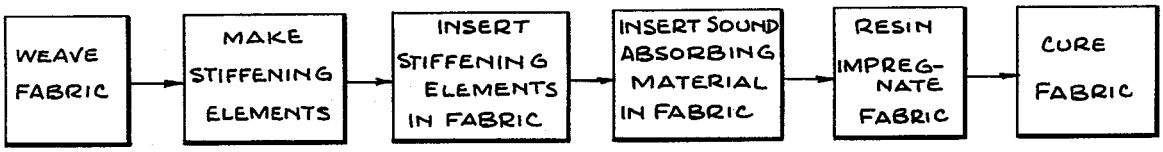

STRUCTURAL SOUND ABSORBING PANEL FOR UNDERWATER USE AND METHODS OF MAKING SAME

BACKGROUND OF THE INVENTION

1. Field of the Invention

The present invention relates to sound absorbing structures for use in underwater applications.

2. History of the Prior Art

The present technology has provided a variety of different designs and constructions of sound absorbing panels and similar structures for use in various different applications. However in the case of underwater applications, the choice is highly limited due to the problem of providing a panel or structure which can withstand the high pressures present in most underwater applications. For example it is known to cover the hulls of naval underwater vessels with sound absorbing material for the purpose of absorbing energy waves within the water such as a SONAR signal transmitted by an enemy vessel.

However current acoustical panels and materials have proven to be undesirable or unsatisfactory for underwater applications in which relatively high water pressures are involved. In these instances, the sound absorbing material is mounted on the hull of the vessel or otherwise disposed so as to be directly exposed to the water. The high water pressure results in substantial compression of the material so as to severly limit its sound absorbing capabilities. In addition the high degree of compression may alter the buoyancy and other properties of the sound absorbing material to an undesirable extent.

To avoid these problems inherent in direct exposure of acoustically absorbent material to the water and its pressure, one approach has been to consider the use of a housing of the type which would transmit sound to the sound absorbent material stored therein while at the same time being capable of withstanding the high water pressure so as to prevent compression of the sound absorbing material. While this approach has appeared to hold considerable promise from a theoritical basis, it has gone unfulfilled because of the problems inherent in designing a structure which will withstand the high water pressures and at the same time act as a housing with good acoustical transmission to the interior thereof.

Brief Description of the Invention

The present invention provides a structural underwater panel for storing sound absorbing material therein. The panel is capable of withstanding extremely high water pressures while at the same time readily passing wave energy to the interior thereof to be absorbed by the sound absorbing material.

Panels in accordance with the invention preferably comprise an integral structure having a pair of relatively thin, generally planar faces disposed in generally parallel, spaced-apart relation and joined by a plurality of interconnecting ribs. The faces and preferably the ribs are of relatively highly sound transmissive material to permit the ready passage of wave energy from surrounding water to the interior for absorption by bodies of acoustically absorbent material stored in individual chambers between the opposite faces as defined by the ribs. At the same time the faces are waterproof so as to prevent the surrounding water from entering the panel and compressing the sound absorbing material. The substantial compressive force on the faces which results is resisted by a plurality of relatively thin, generally planar stiffening elements disposed within the panel and extending between the opposite faces. The stiffening elements which are preferably of highly acoustically transmissive material may be disposed in any appropriate fashion so as to hold the opposite faces in fixed, spaced-apart relation and prevent collapse of the panel as a result of the high water pressure.

In one arrangement in which the ribs are spaced apart from one another and extend generally normally to the planes of the faces, each of the stiffening elements is disposed adjacent a different one of the ribs so as to extend generally normally with respect to the planes of the faces. In a different arrangement in which pairs of the ribs form generally planar pockets therebetween, each stiffening element is disposed within a different one of the planar pockets. In the latter arrangement the rib pairs and pockets defined thereby can extend in any appropriate direction relative to the faces, although a triangular configuration may be preferred for reasons of strength and rigidity.

The faces and adjoining ribs may be integrally woven from a fabric which when resin impregnated and cured provides a relatively stiff and strong structure which is highly transmissive to sound wave energy and at the same time waterproof. The rigidity and waterproof qualities of the faces may be further enhanced where desired by adding laminates of sheet materials which are themselves relatively strong, sound transmissive and waterproof. The stiffening elements may be fabricated of any appropriate materials which make the elements stiff and at the same time acoustically transmissive. Fabrics which have been resin impregnated and cured are desirable for use as the stiffening elements in many applications.

In a method of making a structural underwater sound absorbing panel in accordance with the invention the fabric is woven to form the multi-ply structure and the stiffening elements are made and inserted into the fabric together with the sound absorbing material. The fabric is then resin impregnated and cured to form the finished panel.

Brief Description of the Drawings

The foregoing and other objects, features and advantages of the invention will be apparent from the following more particular description of preferred embodiments of the invention, as illustrated in the accompanying drawings, in which:

FIG. 1 is a perspective view of one arrangement of a structural underwater sound absorbing panel in accordance with the invention;

FIG. 2 is a perspective view of an alternative arrangement of a structural underwater sound absorbing panel in accordance with the invention;

FIG. 3 is a perspective view of a stiffening element for use in the arrangements of FIGS. 1 and 2; and FIG. 4 is a block diagram comprising the successive steps in a preferred method of making an underwater acoustical panel according to the invention.

Detailed Description

FIG. 1 comprises one embodiment of a structural underwater sound absorbing panel 10 in accordance with the invention. The panel 10 includes a pair of relatively thin, generally planar faces 12 and 14 and a plurality of interconnecting ribs 16. A plurality of stiffening elements 18 are disposed within the panel 10 so as to extend between the opposite faces 12 and 14. The ribs 16 and the stiffening elements 18 define a plurality of open space or chambers 20 between the opposite faces 12 and 14. The chambers 20 are filled with bodies of acoustically absorbent material 22.

At least one of the opposite faces 12 and 14 is made so as to be relatively highly acoustically transmissive. In situations where the lower face 14 is mounted on a hull or otherwise disposed so as not to be exposed to water, it may suffice merely to make the face 12 and not the face 14 acoustically transmissive and waterproof. In other situations it may be desirable that both of the faces 12 and 14 possess these proporties.

By making the faces 12 and 14 acoustically transmissive, energy waves such as those produced by a SONAR system are freely passed by the faces to the internal chambers 20 where they are absorbed by the material 22. While not essential for all applications it is desirable that the ribs 16 and the stiffening elements 18 also be acoustically transmissive. In this manner uniform distribution of the wave energy so as to optimize use of the material 22 is insured.

While the panel 10 is shown in FIG. 1 as being open at its sides and ends with the material 22 exposed for purposes of illustration, in actual practice the panel 10 is enclosed in such fashion that only the faces 12 and 14 are exposed to the surrounding water, or the edges are sealed with the fabric-resin laminate to prevent the surrounding water pressure from impinging on the material 22. Because the faces 12 and 14 are substantially impervious to the water or otherwise waterproof, the surrounding water is prevented from entering the chambers 20. Were the water able to enter the chambers 20, it would quickly wet and compress the material 22, thereby destroying most of the effectiveness of the panel 10 as a sound absorber. At relatively great depths within the water such as occur in the case of a submarine, forces are created which tend to compress the faces 12 and 14 toward each other. The stiffening elements 18 resist such compressive forces and maintain the faces 12 and 14 in a fixed, spaced-apart relationship.

For some applications the single thickness of material comprising the faces 12 and 14 will suffice to provide the necessary strength and waterproofing qualities. For most applications, however, it is preferred that the faces 12 and 14 be provided with laminates of material 24 and 26 respectively. Each of the laminates 24 and 26 comprises a plurality of relatively thin generally planar sheets 28 mounted so as to be generally coextensive with the faces 12 and 14. The sheets 28 are comprised of material which is relatively highly sound transmissive and waterproof and which adds considerable strength and rigidity to the faces 12 and 14, particularly with respect to the large compressive forces encountered at substantial depths.

In the panel 10 of FIG. 1 the ribs 16 are disposed so as to be generally normal to the planes of the faces 12 and 14. The stiffening elements 18 which are generally rectangular in their configuration as shown in FIG. 3 are disposed so that each different element 18 abuts a different one of the ribs 16 and is generally normal to the planes of the faces 12 and 14.

A slightly different arrangement is presented by a structural underwater sound absorbing panel 40 shown in FIG. 2. The panel 40 includes opposite faces 42 and 44 which are similar to the faces 12 and 14 of the panel 10 of FIG. 1 and which may have sheets 46 of relatively strong and sound transmissive material stacked thereon to form laminates 48 and 50 as in the case of the sheets 28 which form the laminates 24 and 26 in the panel 10 of FIG. 1. Unlike the arrangement of FIG. 1, however, the panel 40 of FIG. 2 has ribs 52 which are arranged into parallel, spaced apart pairs. Each pair of the ribs 52 defines a generally planar space or pocket 54 therebetween for receiving a stiffening element 56. The pairs of the ribs 54 extend between the opposite faces 42 and 44 in generally zig zag fashion so as to define a plurality of chambers 58 of generally triangular cross section. As in the case of the rectangular chambers 20 of the panel 10 of FIG. 1 the triangular chambers 58 of the panel 40 are filled with acoustically absorbent material 60.

As in the case of the panel 10 of FIG. 1 the faces 42 and 44, with or without the laminated sheets 46, present structures which are sturdy and waterproof and yet which pass wave energy from the surrounding water to the material 60. The ribs 52 and the stiffening elements 56 are also preferably of acoustically transmissive material so as to uniformly distribute the sound wave energy and maximize the effectiveness of the material 60.

The strength and rigidity of the panel 40 and its ability to resist the compressive forces from the surrounding water are in many respects superior to those of the panel 10 of FIG. 1 because of the configuration used. The triangular configuration offers substantial lateral resistance in addition to resistance in the main direction of the compressive forces. The presence of the double rib configuration together with the pockets 54 for accommodating the stiffening elements 56 holds the elements 56 securely in place.

The faces and the ribs of panels in accordance with the invention are preferably integrally constructed such as by weaving them in a three-dimensional, multi-ply configuration using yarns of appropriate material. In the case of the panel 10 of FIG. 1 the integral weaving of the structure shown therein in which the ribs 16 are spaced apart from one another and disposed generally normally to the planes of the faces 12 and 14 may employ any conventional technique for weaving such structures such as the technique described in U.S. Pat. No. 3,102,559 of Koppelman et al., WOVEN HONEYCOMB CELLULAR FABRICS. The fabric as so woven is preferably laid up by resin impregnation and curing to add desired stiffness and other properties including waterproofing as described hereafter. The sheets 28 may comprise woven or other materials attached to the faces 12 and 14 as well as to one another such as by resin impregnation and curing during the lay-up process.

The ribs 52 and the faces 42 and 44 of the panel 40 of FIG. 2 are also preferably integrally formed such as by weaving using yarns of appropriate composition. Such a structure may be fabricated using the techniques described in a co-pending application assigned to the same assignee as the present application, Ser. No. 290,546, Walter A. Rheaume, filed Sept. 20, 1972 and entitled MULTI-PLY WOVEN ARTICLE HAVING DOUBLE RIBS. Again the woven fabric is preferably laid up by resin impregnation and curing as described hereafter with the sheets 46 being prepared and attached by a similar process.

The yarns used to integrally weave the faces and interconnecting ribs of panels in accordance with the invention may be comprised of any appropriate material having relatively high strength and which bonds readily with an impregnating resin. Examples of yarn material which can be used for this purpose include fiberglass, polyester, nylon and polypropylene. The woven fabric is impregnated with an appropriate resin which strengthens and regidizes the fabric, renders it waterproof and at the same time maintains a high degree of sound transparency. Most epoxy resins have been found suitable for this purpose. Where the acoustic transmission is reduced below an acceptable level such as may be due to the thickness of the resin, acoustic transmission can be improved by adding a mixture of nitrile rubber and miniature glass microspheres to the resin.

The sheets of material 28 and 46 added to the faces can be of any appropriate material which is readily bonded to the faces so as to add strength to the faces, enhance the waterproof quality of the faces and at the same time maintain a high degree of sound transmission. Materials such as layers of fiberglass may be resin impregnated and bonded to the faces to achieve the desired characteristics of increased strength and impermeability to water without having a significant effect on the acoustic transmission.

The sound absorbing material such as the material 22 of the panel 10 of FIG. 1 and the material 60 of the panel 40 of FIG. 2 can comprise any appropriate material which has very high sound absorbency and is easily shaped, molded or otherwise formed so as to fill the chambers within the panels. Examples of materials which can be used include polyurethane foam and rubber type foams.

FIG. 3 depicts a typical shape of the stiffening elements 18 and 56 as used in the embodiments of FIGS. 1 and 2 respectively. The stiffening elements are comprised of relatively stiff and rigid material which is also preferably highly sound transmissive. Accordingly the stiffening elements can be fabricated from woven fabric which is resin impregnated and cured. The yarns of the fabric can be of any appropriate material such as fiberglass, and the resin can be of any appropriate type such as epoxy or polyester. As in the case of the faces and ribs the resin used to impregnate the structures forming the stiffening elements can be mixed with selected amounts of nitrile rubber and miniature glass microspheres where it is desired to increase the sound transmission properties of the resulting stiffening elements. The stiffening elements may also be comprised of unidirectional materials or fibers as well as materials which are multidirectional. Further examples of materials and methods of fabrication for use in making the stiffening elements are set forth in a co-pending application assigned to the same assignee as the present application, Ser. No. 290,541, Donald M. Hatch, filed Sept. 20, 1972 and entitled MULTI-PLY WOVEN ARTICLE HAVING STIFFENING ELEMENTS BETWEEN DOUBLE-PLYS. Substantially all of the materials disclosed in that application can be used in fabricating stiffening elements for use in the present invention with the exception of certain metals which lack the desired property of sound transmission.

The successive steps in a method of making structural underwater sound absorbing panels in accordance with the invention are shown in FIG. 4. The first step depicted is to weave an integral, multi-ply fabric which defines the faces and the interconnecting ribs. At the same time the stiffening elements are made such as by cutting from selected materials or by weaving a fabric and resin impregnating and curing the fabric. Next the formed stiffening elements are inserted within the woven fabric, followed by insertion of the sound absorbing material. In a panel arrangement such as that of FIG. 1 the stiffening elements 18 are simply placed against the ribs 16 to hold the faces 12 and 14 apart while the chambers 20 as so formed are filled with the absorbent material 22. In the case of the panel 40 of FIG. 2 the formed stiffening elements are inserted into the pockets 54 formed by the pairs of ribs 52, and the resulting chambers 58 are filled with the absorbent material 60. The resulting structure is then impregnated with a resin system, following which curing is effected to form the finished structure. Where sheets such as the sheets 28 and 46 are to be added to reinforce the faces and enhance the other properties thereof, the sheets may be bonded to the faces as a part of the lay-up and curing processes or the addition of the sheets may be done separately.

Structural underwater sound absorbing panels formed in accordance with the invention have been found to be capable of withstanding flatwise compression loads on the order of 2,500–4,000 psi, while at the same time being highly transmissive with respect to sound wave energy so as to effectively dampen or eliminate such wave energy in underwater applications. Such panels have other highly desirable properties including low cost and extreme lightness in weight.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A structural sound absorbing panel for use in limiting reflections of impinging sound waves in high pressure water environments comprising a load bearing panel including a pair of opposite faces comprised substantially of fabric reinforced composite which is relatively sound transmissive to the impinging sound waves, at least one of the pair of opposite faces being impermeable to water, the load bearing panel also including a plurality of ribs of fabric reinforced composite, the fabric therein being interwoven with the fabric of the opposite faces to form a lightweight structure, a plurality of stiffening elements which are relatively sound transmissive to the impinging sound waves disposed adjacent the ribs within the load bearing panel, the ribs and the stiffening elements defining a plurality of separate chambers between the opposite faces, the ribs, stiffening elements and faces being relatively thin compared to the dimensions of the chambers so that the chambers comprise a substantial portion of the total volume occupied by the panel, and uncompressed material of relatively high sound absorbency disposed within at least some of the chambers, the stiffening elements extending between and holding the opposite faces in spaced-apart relation against external compressive forces to resist compression of the material of relatively high sound absorbency, and the at least one of the pair of opposite faces which is impermeable to water protecting the material of relatively high sound absorbency from water on the outside of the panel.

2. The invention defined in claim 1, wherein the stiffening elements are relatively thin, generally rectangular elements disposed in generally parallel relation to adjacent ones of the ribs.

3. The invention defined in claim 2, wherein the ribs are arranged in pairs with each pair being generally parallel to each other and having a stiffening element disposed therebetween.

4. A panel for absorbing sound waves in high pressure liquid environments comprising a pair of relatively thin, generally planar faces of material woven from yarns, the material of the faces being relatively highly sound transmissive and impermeable to liquid, a plurality of relatively thin, generally planar ribs of relatively highly sound transmissive material extending between and disposing the faces in generally parallel, spaced-apart relation, the material of the ribs being woven from yarns which are also interwoven with the yarns of the material of the faces, the ribs forming a plurality of pockets between the faces, a plurality of elements of relatively stiff and highly sound transmissive material disposed adjacent the ribs and extending between the faces, and a plurality of bodies of relatively highly sound absorbent material disposed within the pockets, the ribs and the elements resisting compression of the panel and the included bodies of relatively highly sound absorbent material in response to liquid pressure on the outside of the panel, and the impermeable faces preventing liquid on the outside of the panel from reaching the bodies of relatively highly sound absorbent material.

5. A panel for absorbing sound waves in underwater applications comprising a fabric having a plurality of different plies defining a pair of opposite faces and a plurality of intermediate rib portions extending between and being interwoven with the opposite faces, at least one of the opposite faces being waterproof and sound transmissive, and a plurality of relatively stiff elements disposed within the fabric and extending between the opposite faces, the elements and the rib portions defining a plurality of pressure resistant chambers of nominal size between the opposite faces, means disposed within the chambers for absorbing sound waves, the elements, the rib portions and the faces having thicknesses which are very substantially less than the thickness of the chambers defined by the distance between the opposite faces and the length of the chambers defined by the distance between adjacent rib portions and element pairs, the rib portions and the relatively stiff elements acting to maintain the faces in fixed, spaced-apart relation against the compressive forces of water on the outside of the panel to maintain the nominal size of the pressure resistant chambers while at the same time freely admitting sound waves from water on the outside of the panel into the chambers.

6. The invention defined in claim 5, further including a laminate of generally planar reinforcing sheets fastened to at least one of the opposite faces so as to be generally coextensive therewith, the reinforcing sheets being waterproof and highly sound transmissive.

7. The invention defined in claim 5, wherein the rib portions are arranged into pairs with each pair defining a generally planar pocket therebetween, and the elements are of generally planar configuration and each is disposed within a different one of the planar pockets.

8. The invention defined in claim 5, wherein the fabric is impregnated with a resin containing glass microspheres and nitrile rubber.

* * * * *